United States Patent [19]

Olson

[11] Patent Number: 4,542,360

[45] Date of Patent: Sep. 17, 1985

[54] ELECTROMAGNETIC RELAY HAVING DUAL ACTING ARMATURE

[75] Inventor: Elwyn H. Olson, St. Paul, Minn.

[73] Assignee: Honeywell Inc., Minneapolis, Minn.

[21] Appl. No.: 541,395

[22] Filed: Oct. 12, 1983

[51] Int. Cl.[4] ..... H01H 51/06

[52] U.S. Cl. ..... 335/203; 335/276

[58] Field of Search ..... 335/128, 203, 270, 276, 335/279, 274

[56] References Cited

U.S. PATENT DOCUMENTS 3,444,491 5/1969 Whitaker ..... 335/128

3,958,198 5/1976 Minks ..... 335/203

*Primary Examiner*—John C. Martin

*Assistant Examiner*—George Andrews

*Attorney, Agent, or Firm*—Mitchell J. Halista; Trevor B. Joike

[57] ABSTRACT

An electromagnetic relay having a dual acting armature has a U-shaped armature with two divergent legs. The armature is pivoted on one of the legs with the pivoted leg being arranged adjacent to an electromagnetic field producing structure including an electrically energizable coil. A first movable electrical contact carrying means is arranged to cooperate with a first one of the legs of the armature to produce a motion of a first electrical contact between a first and a second position in response to an energized and a non-energized state of the coil, respectively. Concurrently, a second movable electrical contact carrying means is arranged to cooperate with the other or second leg of the armature to produce a motion of a second electrical contact between a first and a second position in response to an energized and deenergized state of the coil, respectively. The coil is located in the bight of the U-shaped armature with the pivoted first leg being urged by a spring away from the coil. Since the legs of the armature are on opposite sides of the coil, the motions of the first and second arms induced by the coil are in the same rotational directions. Fixed electrical contacts are arranged to cooperate with the first and second movable contacts to produce corresponding electrical connections therewith in the first and second positions of the first and second movable contacts.

11 Claims, 1 Drawing Figure

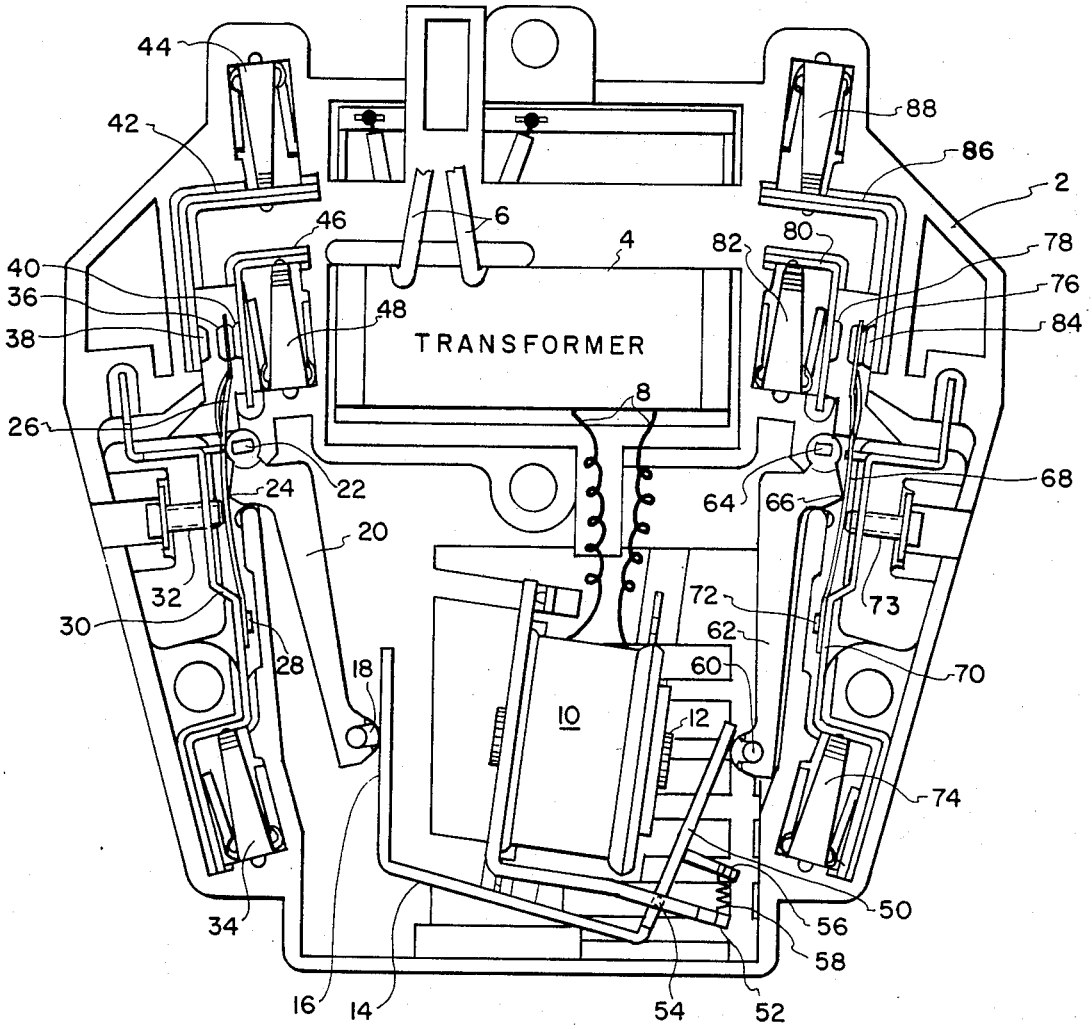
TRANSFORMER
44
42
88
86
2
46
6
4
82
80
78
40
36
38
48
76
84
26
8
68
24
22
64
66
20
32
72
73
30
62
28
18
60
70
10
12
74
34
50
56
58
16
14
54
52

ELECTROMAGNETIC RELAY HAVING DUAL ACTING ARMATURE

BACKGROUND OF THE INVENTION

The present invention relates to an electromagnetic switching device. More specifically the present invention is directed to an electromagnetic switching device having a dual acting armature.

SUMMARY OF THE INVENTION

An object of the present invention has provided an improved electromagnetic switching device having a dual acting armature.

In accomplishing this and other objects, there has been provided, in accordance with the present invention an electromagnetic relay having a pivoted U-shaped armature with an actuating coil means located in a bight of the armature for effecting a pivotal movement of the armature, a movable electrical contact means selectively moved by the armature and a fixed contact means arranged to cooperate with the movable contact means.

BRIEF DESCRIPTION OF THE DRAWINGS

A better understanding of the present invention may be had when the following detailed description is read in connection with the accompanying drawing, in which the single FIGURE is a pictorial illustration of an electromagnetic relay embodying an example of the present invention.

DESCRIPTION OF THE PREFERRED EMBODIMENT

Referring to the single FIGURE drawing in more detail, there is shown an electromagnetic relay having an electrically insulating support base 2 arranged to carry a power transformer 4 having a pair of input leads 6 and a pair of output leads 8. The input leads 6 are arranged 8. The input leads 6 are arranged to be connected to a source of electrical energizing power (not shown) while the output leads 8 are connected to a relay coil 10 wound on a magnetic field core 12. A U-shaped armature 14 is arranged to partially encircle the relay coil 10, i.e., the coil 10 is located in the bight of the "U". A first leg 16 of the armature 14 is arranged in contact with a roller 18 which is rotateably attached to a free end of a first arm 20. The arm 20 is pivoted on a pivot 22 located at the other end of the arm 20 from the roller 18. Intermediate the pivot 22 and the roller 18, a first contact actuating projection 24 is located on the first arm 20 and is arranged to be in contact with a first electrical contact carrying and electrically conductive flexible strip 26. The strip 26 is attached at one end by a rivet 28 to a first rigid electrically conductive support 30. A first adjustment screw 32 facing the strip 26 is attached to the support 30 to adjust the overcenter operating position of the strip 26 to affect the motion of the strip 26 induced by the projection 24.

A first electrical terminal leaf spring 34 mounted on the base 2 provides a means for affording an electrical connection to the flexible strip 26 through the support member 30 and the rivet 28. Specifically, a bare end of an electrical wire can be selectively inserted between the spring 34 and the support 30 to be retained therebetween by the spring 34. A free end of the strip 26 is arranged to carry a double-faced electrical contact 36 which is selectively positionable in contact with a first fixed contact 38 and a second fixed contact 40 in a first and a second position of the strip 26, respectively. The first fixed contact 38 is connected by a first electrical conductor 42 which provides a second electrical connection in combination with a second leaf spring 44 mounted on the base 2. Similarly, the second contact 40 is connected by a second electrical conductor 46 which provides a third electrical connection in combination with a third leaf spring 48 mounted on the base 2.

The other leg 50 of the U-shaped armature 14 is pivoted on a support arm 52 extending from a support frame 53 for the relay coil 10, i.e., at a pivot 54. A tab 56 extending from the leg 50 is connected by a spring 58 to the arm 52. The second leg 50 is arranged in contact with a second roller 60 which is rotatably attached to a free end of a second arm 62. The second arm 62 is pivoted at a pivot 64 located at the other end of the arm 62 from the roller 60. The second arm 62 is provided intermediate the roller 60 and the pivot 64 with a second contact actuating projection 66 which is arranged to contact a second electrical contact carrying and electrically conductive flexible strip 68. The second strip 68 is riveted to a second rigid electrically conductive support 70 by a second rivet 72. A second adjustment screw 73 is provided on the second support 70 to adjust the overcenter operating position of the second strip 68 to affect the motion of the second strip 68 induced by the second projection 66.

The second support 70 is provided with an electrically connection means afforded by a fourth electrical terminal leaf spring 74 mounted on the base 2. A free end of the second strip 68 is arranged to carry a second double-faced electrical contact 76 which cooperates with a third fixed electrical contact 78 connected to a third electrical conductor 80 which faces a fifth electrical terminal leaf spring 82 mounted on the base 2. Similarly, a fourth fixed electrical contact 84 is connected to a fourth electrical conductor 86 which cooperates with a sixth electrical terminal leaf spring 88 mounted on the base 2. The aforesaid elements are mounted on the support base 2 to provide a positioning and spacing thereof in a manner well-known in the art. The specific details of this mounting are believed to be unnecessary for a complete understanding of the present invention.

In operation, the relay of the present invention is arranged to attract the second leg 50 of the U-shaped armature 14 to the core 12 when the relay coil 10 is energized and to allow the spring 58 to urge the second leg 50 away from core 12 when the coil 10 is deenergized. In the position shown in the single FIGURE drawing, the relay coil 10 is deenergized, and the U-shaped armature 14 is pivoted on the pivot 54 in response to the spring 58. In this position of the armature 14, the first flexible strip 26 is positioned to produce a contact between the movable contact 36 and the second fixed contact 40 to effect an electrical connection between the first electrical terminal leaf spring 34 and the third electrical terminal leaf spring 48. Concurrently, the second flexible strip 68 is positioned to produce a contact between the movable contact 76 and the fourth fixed contact 84 to effect an electrical connection between the fourth electrical terminal leaf spring 74 and the sixth electrical terminal leaf spring 88. Assuming that the coil 10 had been energized and is then deenergized, the positions of the contacts and the armature 14 shown in the drawing is achieved by the first roller 18 rolling along the first leg 16. This rolling motion of the roller 18 is produced by a pivoting movement of the armature 14 on the pivot 54 induced by the spring 58 and is effective to release the first flexible strip 26 from a deflected position near the first adjustment screw 32. This motion of the first strip 26 transfers the first movable contact 36 from the first fixed contact 38 to the second fixed contact 40. Concurrently, the second armature leg 50 is urged by the spring 58 to a rolling motion of the second roller 60 to displace the second arm 62. The second projection 66 on the second arm 62, accordingly, deflects the second strip 68 towards the second adjustment screw 73. This motion of the second strip 68 transfers the second movable contact 76 from the third fixed contact 78 to the fourth fixed contact 84.

An energization of the relay coil 10, on the other hand, attracts the second leg 50 of the armature 14 which pivots on the pivot 54 to allow the second pivoted arm 62 and the second extension 66 to release the second flexible strip 68 into an undeflected position. This motion of the second strip 68 transfers the movable contact 76 from the fourth fixed contact 84 to the third fixed contact 78 to effect an electrical connection between the fourth electrical terminal leaf spring 74 and the fifth electrical terminal leaf spring 82. Concurrently, the first leg 16 of the armature 14 moves the first arm 20 via the first roller 18 to enable the first projection 24 to force the first strip 26 toward the first adjustment screw 32 and to deflect the free end of the strip 26. This motion of the strip 26, in turn, transfers the first movable contact 36 from the second fixed contact 40 to the first fixed contact 38 to effect an electrical connection between the first electrical terminal leaf spring 34 and the second electrical terminal leaf spring 44. The arcuate travel of each arm 20, 62 is adjusted to be the same by controlling the angle of the leg 16 forming the U-shaped armature 14. Thus, the relay of the present invention provides a double acting electrical switching capability while utilizing a compact structure with the armature 14 partially encircling the actuating coil 10.

Accordingly, it may be seen that there has been provided, in accordance with the present invention, an improved electromagnetic relay having a dual acting armature.

The embodiments of the invention in which an exclusive property or privilege is claimed are defined as follows:

1. An electromagnetic relay comprising a U-shaped armature, a single pivot means for said armature, an actuating coil means located in a bight of said armature for effecting a pivotal movement of said armature on said pivot means, said coil means including a core means extending between the legs of said U-shaped armature and said armature rotating on said pivot means in a plane parallel to a plane containing a longitudinal axis of said core means, a movable electrical contact means selectively moved by said armature and a fixed electrical contact means arranged to cooperate with said movable contact means, wherein said movable contact means includes a double faced electrical contact and said fixed contact means includes a first electrical contact arranged to contact one face of said double faced contact in an energized state of said relay and a second electrical contact arranged to contact another face of said double faced contact in a deenergized state of said relay.

2. An electromagnetic relay comprising a pivoted U-shaped armature, an actuating coil means located in a bight of said armature for effecting a pivotal movement of said armature, a movable electrical contact means selectively moved by said armature and a fixed electrical contact means arranged to cooperate with said movable contact means, wherein said movable contact means includes a pivoted arm having a free end contacting said armature and arranged to be displaced by a pivotal motion of said armature and an electrically conductive strip fixed at one end and carrying an electrical contact on a free end of said strip, said arm being arranged to contact said strip to transfer a motion of said arm to said strip.

3. A relay as set forth in claim 2 wherein said movable contact means includes an electrical terminal means attached to said strip.

4. A relay as set forth in claim 3 wherein said fixed contact means includes an electrical terminal means.

5. A relay as set forth in claim 1 wherein said pivot means and a spring means arranged to urge one leg of said armature away from said core means.

6. A relay as set forth in claim 2 wherein said coil means includes a core means facing one leg of said armature and a spring means arranged to urge said one leg of said armature away from said core means.

7. A relay as set forth in claim 5 wherein said pivot means includes a support arm means for pivotally supporting said one leg of said armature and said spring means is arranged between said one leg of said armature and said support arm.

8. A relay as set forth in claim 6 wherein said coil means includes a support arm means for pivotally supporting said one leg of said armature and said spring means is arranged between said one leg of said armature and said support arm.

9. A relay as set forth in claim 2 wherein said coil means includes a core means extending between the legs of said U-shaped armature and said armature pivots in a plane parallel to a plane containing a longitudinal axis of said core means.

10. A relay as set forth in claim 1 wherein the ends of said core means are unequally spaced from the adjacent respective leg of said armature.

11. A relay as set forth in claim 9 wherein the ends of said core means are unequally spaced from the adjacent respective leg of said armature.

* * * * *